United States Patent [19]

Treudler

[11] Patent Number: 4,658,773

[45] Date of Patent: Apr. 21, 1987

[54] APPARATUS FOR TRANSFERRING A HIGH VOLTAGE TO THE IGNITION ELEMENTS OF AN INTERNAL COMUBUSTION ENGINE

[76] Inventor: Reinhard Treudler, Am Kuhlen Grund 22, 6237 Liederbach/Taunus, Fed. Rep. of Germany

[21] Appl. No.: 751,195

[22] PCT Filed: Oct. 29, 1984

[86] PCT No.: PCT/DE84/00226

§ 371 Date: Aug. 19, 1985

§ 102(e) Date: Aug. 19, 1985

[87] PCT Pub. No.: WO85/01991

PCT Pub. Date: May 9, 1985

[30] Foreign Application Priority Data

Oct. 28, 1983 [DE] Fed. Rep. of Germany ..... 3339085

[51] Int. Cl.[4] ..... F02P 1/00

[52] U.S. Cl. ..... 123/146.5 A; 123/628; 200/19 R

[58] Field of Search ..... 123/146.5 A, 628; 200/19 R, 11 A, 19 D C, 8 R

[56] References Cited

U.S. PATENT DOCUMENTS

| | | | |
|---|---|---|---|
| 886,225 | 4/1908 | De La Valette | 123/146.5 A |
| 1,110,415 | 9/1914 | Zika | 123/146.5 A |
| 3,789,168 | 1/1974 | Meyer | 200/19 R |
| 3,799,135 | 3/1974 | House | 123/146.5 A |
| 4,488,530 | 12/1984 | Turetsky | 123/146.5 A |

FOREIGN PATENT DOCUMENTS

| | | | |
|---|---|---|---|
| 849498 | 9/1952 | Fed. Rep. of Germany | 123/146.5 A |
| 898526 | 11/1953 | Fed. Rep. of Germany | 123/146.5 A |
| 1230614 | 12/1966 | Fed. Rep. of Germany | 123/146.5 A |
| 1277633 | 9/1968 | Fed. Rep. of Germany | 123/146.5 A |
| 2233830 | 1/1974 | Fed. Rep. of Germany | 123/146.5 A |
| 2404417 | 8/1974 | Fed. Rep. of Germany | 123/146.5 A |
| 2811049 | 9/1978 | Fed. Rep. of Germany | 123/146.5 A |

OTHER PUBLICATIONS

Elektronik Magazine, 9/77, pp. 64–68, German Publication.

*Primary Examiner*—Ronald B. Cox

*Attorney, Agent, or Firm*—Sughrue, Mion, Zinn, Macpeak and Seas

[57] ABSTRACT

Process for transferring a high voltage to the ignition elements of an internal combustion engine with a priming device comprising a first electrode unit (1) and a second electrode unit (2) which form spark discharger gaps, the high voltage being provided to one of the electrode units and the other electrode unit being connected to the ignition elements of the internal combustion engine. The conventional ignition systems have the following disadvantage: the high voltage must be generated, in case of need, each time repeatedly and exactly at the ignition time point. Furthermore, the ignition systems do not offer the possibility of reducing the air proportion λ and reducing the emission of noxious substances by variation of the ignition. Therefore, there is proposed to separate the spark discharger gaps of the electrode unit by a high voltage insulating medial part (3) when no high voltage is to be transferred to the ignition element of the internal combustion engine, and to free the spark discharger gaps of the electrode units by means of devices when a high voltage is to be transferred to the ignition elements of the internal combustion engine.

5 Claims, 26 Drawing Figures

APPARATUS FOR TRANSFERRING A HIGH VOLTAGE TO THE IGNITION ELEMENTS OF AN INTERNAL COMUBUSTION ENGINE

BACKGROUND OF THE INVENTION

The invention is directed to an apparatus for transferring a high voltage to the ignition elements of an internal combustion engine. The apparatus comprises first and second units which form spark discharge gaps, the high voltage being provided to one of the electrode units and the other electrode unit being connected to the ignition elements of the internal combustion engine.

In order to ignite a gas-air mixture in a cylinder of an internal combustion engine, a high voltage is transferred to an ignition element provided in the cylinder. The cylinders are selected according to the firing order by means of a flash-over distributor. In order to do this, the high voltage generated in a high voltage generating device at the firing point is supplied to a distributor rotor. At the point of ignition of the cylinder, a first electrode unit provided at the rotor is positioned opposite a second electrode unit, which is connected to the ignition element provided in the cylinder via a connecting line, said cylinder containing the inflammable gas-air mixture. Therefore, at the firing point, the first electrode unit of the rotor and the second electrode unit form a spark discharge gap, which is placed in series with the spark discharge gap of the ignition element, for example, the electrodes of a spark plug. The high voltage generated in the high voltage generating device at the firing point flashes over from the first electrode unit to the second electrode unit and between the electrodes of the plug so that the inflammable gas-air mixture is ignited.

The high voltage generating device which always generates the high voltage necessary for the ignition only at the respective firing point, mostly consists of an ignition coil (SZ) comprising an autotransformer, whose first primary winding is connected to an interruptor and whose second primary winding is connected to the line voltage of the automobile. If the interruptor, which mostly is also accommodated in the distributor, is closed, a magnetic field is created due to the current flow through the primary coil. At the firing point, the interruptor is opened and a high voltage is produced at the secondary winding of the ignition coil. The thus produced high voltage is supplied from the secondary winding of the ignition coil to the first electrode unit of the rotor in the distributor. Without mentioning the numerous losses, the magnetic energy stored in the primary winding is substantially supplied to the respective ignition element, said magnetic energy being calculated according to the formula $$W_L = \frac{1}{2} L i^2$$

("L" corresponds to the inductivity, "i" corresponds to the current, which flows through the primary winding at the firing point and is interrupted.)

The high voltage generation by means of the coil ignition produces a spark at the electrodes of the plug, said spark having a long burning time, and the coil ignition is quite cheap so that it is mostly used in small and in middle class cars. However, besides the advantages, said coil ignition also has considerable disadvantages, as e.g., that the contacts of the interruptor burn up, that the mechanical operating devices of the interruptor get worn out, and that the amplitude of the high voltage decreases in intensity with an increased rotational speed of the motor and thus with the generation frequency. In order to eliminate a part of the numerous disadvantages of the coil ignition, a transistor-coil ignition (TSZ) was proposed as a further development. There, the interruptor is replaced by a transistor, whereby the break contact is relieved and need not be substituted so soon.

On the one hand, the transistor-coil ignition eliminates disadvantages of the coil ignition (SZ) but, on the other hand, causes disadvantages, as e.g., temperature dependence problems, and does not eliminate all disadvantages.

Therefore, on the basis of the coil ignition and the transistor-coil ignition, the capacitor ignition (HKZ) was proposed as a further development. The difference between the capacitor ignition and the aforementioned ignitions SZ, TSZ is that the necessary ignition energy—leaving losses apart—is not longer stored in a coil but in a capacitor. Thus, the ignition energy is in relation with the energy stored in the capacitor, which can be determined by the formula $$W_C = \frac{1}{2} C u^2$$

("C" corresponds to the capacity of the capacitor, "u" corresponds to the voltage, with which the capacitor is charged up to the ignition time point.)

At the ignition time point, the capacitor is mostly discharged via a thyristor. The discharging current of the capacitor flows through the primary winding of a transformer, at the secondary side of which a high voltage pulse is produced, which is supplied to the respective ignition element via a first electrode unit of the rotor. It is true that the capacitor ignition furnishes a high voltage pulse compared to the aforementioned ignitions, said high voltage pulse showing a steep increase, but, on the other hand, the burning time of the high voltage pulse is very low compared to the other ignitions. Therefore, numerous mixed form of the mentioned ignitions SZ, TSZ and HKZ were further proposed. Furthermore, it was proposed—due to the above-mentioned difficulties and other difficulties—to use so-called "contactless interruptors", as e.g., hall probes, field plates, optical sensors, etc.

Despite developing attempts lasting for decades it has not been possible, by using one of the mentioned ignitions SZ, TSZ, HKZ and a mixed form thereof, to solve the problem of the emission of noxious substances, like nitrogen oxide and hydrocarbon, tightly connected with the ignition. In order to reduce the emission of noxious substances and the consumption of gasoline, it was thus proposed to acquire all operating data of the internal combustion engine, to process said data in a micro-processor system and to control one of the above-mentioned ignitions by means of this microprocessor system.

The disadvantage of the above-mentioned ignition systems is that they use a principle of high voltage generation, in which the required high voltage is always generated shortly before the firing point. As can be easily realized, it is difficult, especially when there are high rotational speeds, to generate a hundred times per minute an ignition pulse of sufficient intensity, of large steep rise times and with a long spark burning time and to bring the ignition pulse to coincidence with the optimum point of ignition, which is constantly varying.

Should, in addition thereto, the emission of noxious substances be influenced via the ignition, this will inevitably lead to highly-sophisticated, electronic systems, if one of the above-mentioned ignitions is used, wherein the high voltage generation and the use thereof almost coincide. In this connection, those of the above-mentioned ignition systems which are useful to a certain extent, have a very large number of electronic components. Due to these high numbers of components and due to the required reliability—the probability of the failure does not show a linear rise with an increased number of components—the proposed ignition systems and the ignition systems to be expected, which build up on these known ignition systems, are too expensive, especially for small cars and middle class cars which, moreover, represent the majority of automobiles. Consequently, it will be difficult to reduce the emission of noxious substances, especially of hydrocarbons and nitrogen oxides, by means of one of the cited ignition systems using the principle of generating the high voltage each time shortly before its utilization.

As is explained above, the ignition energy is derived from the energy stored temporarily in a coil or a capacitor, whereby the energy in the coil or in the capacitor is obtained each time shortly before its utilization at the ignition time point, by creating magnetic or electric fields. Apart from the fact that this principle of high voltage generation—the point of time of the high voltage generation nearly coincides with the firing point—entails all difficulties of a transient process, and this kind of high voltage generation additionally shows a very bad efficiency; further, this kind of high voltage generation is not suited for influencing the emission of noxious substances via the ignition, as will be explained in the following.

In order to reduce the emission of noxious substances as nitrogen oxide and hydrocarbons, it is necessary to adjust the fuel-air mixture ratio in a direction to a larger air proportion, the so-called "lean concept". The fuel-air mixture is designated by and represents the ratio of an air mass acutally supplied for burning a fuel mass to the air mass theoretically required for a perfect combustion. In this connection, $\lambda > 1$ corresponds to the combustion under excessive air (lean mixture) and $\lambda < 1$ corresponds to the combustion under a fuel surplus (rich mixture). In internal combustion engines working according to the Otto-engine the air proportion $\lambda$ lies in the range of $\lambda = 0.8$ to 1.2. Further, it is known that with an air proportion of $\lambda = 1.3$ there exists a point of intersection between the curves of the noxious emission of hydrocarbon and the noxious emission of nitrogen oxide. With an air proportion larger than $\lambda = 1.3$, the emission of hydrocarbon increases and the nitrogen oxide content further decreases. Vice versa, the nitrogen oxide content increases with an air proportion $\lambda = 1.3$ and the emission of hydrocarbon slightly decreases.

For igniting a fuel-air mixture with a conventional ignition system—as described above—within the short period of time, in which the ignition pulse is applied to the electrodes of the plug, it is necessary that there exists an inflammable mixture when the spark flashes over between the electrodes of the plug. If the fuel-air mixture contains a larger air proportion $\lambda$ due to the lean concept, shifted more in direction to the probability in conventional ignition systems decreases that the ignition spark meets with an inflammable mixture within the short period of time of the flashing-over. If a coil is used for the energy temporary storage, the ignition spark has a sufficient burning time but the steep rise time of the high voltage pulse is missing, as is the case in the ignition system working according to the HKZ-principle, which uses a capacitor for temporarily storing the energy. Just when there is lean fuel-air mixture with a large air-proportion, it is necessary for inflamming the mixture that the high voltage pulse between the electrodes of the plug shows a steep rise in voltage and a sufficient burning time. In the conventional ignition systems as mentioned above both requirements can be fulfilled—if at all—only by means of a large expenditure of electronic components.

Furthermore, the above-mentioned conventional ignition systems have the disadvantage that at the ignition time point only a determined energy amount is provided. Part of this energy amount must be used to cover the losses in the ignition system, and moreover, part of the energy is lost due to the charging of parasitic capacities, which are formed through the lines, and furthermore, part of the energy demand must be used to ionize the spark discharger gaps and to create the plasma or spark discharger gap channel. Only the remaining part of the energy demand provided by the conventional ignition systems serves to inflame the gas mixture.

Moreover, in conventional ignition systems, it will be possible to fulfil the inflammation of unleaded fuel or of other fuels, by meeting the above requirements, only with an additionally larger expenditure of components.

SUMMARY OF THE INVENTION

Therefore, the problem underlying the present invention is to provide an ignition process and a device for implementing such process for internal combustion engines, in which the above-mentioned disadvantages of conventional ignition systems are eliminated, which is cheap and which enables that the inflammability of the fuel-air mixture is improved with an increased air proportion and that the emission of noxious substances is reduced.

According to the present invention, a process is provided which enables in an inventive manner to choose from a constant permanent-high-voltage-offer in a successive and sectional way the respective ignition energy for the ignition elements.

In this connection, the ignition energy supplied to the ignition elements is completely independent of the rotational speed, of transient processes and of time constants. It rather is possible to control the permanent high-voltage continuously generated in a high voltage generation device, and a direct high voltage or an alternative high voltage can be supplied to the ignition elements depending upon the type of the fuel-air mixture, as for instance, by using methanol. Moreover, it is possible according to present invention to supply the high voltage such that an optional spark burning time is applied to the ignition elements. Said spark burning time can be easily varied and, in addition thereto, the high voltage supplied to the ignition elements has such a steep voltage rise which lies in the range of 1 $\mu$-second and which cannot be reached with conventional ignition systems due to the transient processes. The process according to the invention therefore represents a real process for controlling high voltage, wherein—in case of need—individual and optional high voltage pulses can be chosen from a constant permanent-high-voltage-offer without electronic components. The process according to the invention now offers numerous variation possibilities with regard to high voltage pulse sequence, high voltage pulse length, high voltage intensity, high voltage type, generation of couble-sparks to one or several plugs, and a simple possibility to vary the ignition time point. Thus, the inventive process enables that the inflammability is guaranteed to a more probable extent with the different operation data of the internal combustion engine and the different fuel-air mixture conditions that, this is the case with the conventional ignition systems.

The devices which relate to a preferred embodiments of the invention for implementing the inventive process, have a simple and cheap construction. The devices can be coupled to an internal combustion engine without too great an expenditure and reconstruction, e.g. by putting them onto said engine, by replacing the flash-over distributor. The conventional ignition systems thus can be easily replaced by the device for implementing the inventive process.

In this connection, high voltage isolating lateral parts only have to be slightly varied in their position for changing the ignition firing points. Contrary to a conventional ignition system, the masses to be moved are not too large, and the spark discharge gaps can be easily released, in case of need, by centrifugally-dependent flaps or electronically operated shifting devices depending upon the load parameters and the operation data of the motor.

PRIOR ART

From DE-AS No. 11 86 273 an ignition system for multi-cylinder motors without a distributor and interruptor is known, which uses a high voltage generation device generating a permanent high voltage. It is not possible with an ignition system according to DE-AS No. 11 86 273 to derive from the permanent-high-voltage an optional number of sparks with an optional spark burning time and a steep voltage rise.

From DE-PS No. 849 498 a distributor device for ignition systems for operating internal combustion engines is known, said distributor device using so-called distributor switches. The number of distributor switches coincides with the number of the ignition elements, and there are provided as many ignitions coils as ignition elements and distributor switches. The distributor switches are placed in series to the actual break contact and thus the high voltage is operated in the low voltage circuit of the battery; this is a substantial difference to the invention, which directly operates the high voltage and which divides the high voltage into individual high voltage pulses.

From the technical journal "Elektronik" 1977, No. 9, page 67, FIG. 7, an electronic high voltage distributor device is known, comprising several transistors and vour differently polarized diodes, each of which is connected to an ignition element. Apart from the electronic expenditure, this type of high voltage generation is reduced to four ignition elements. If the ignition elements exceed the number of four, a second device of the same construction would have to be used.

BRIEF DESCRIPTION OF THE DRAWINGS

Further details, advantages and embodiments of the invention result from the following description. The figures serve to explain the invention by way of example. They show.

DETAILED DESCRIPTION OF THE PREFERRED EMBODIMENTS

Figure 1:
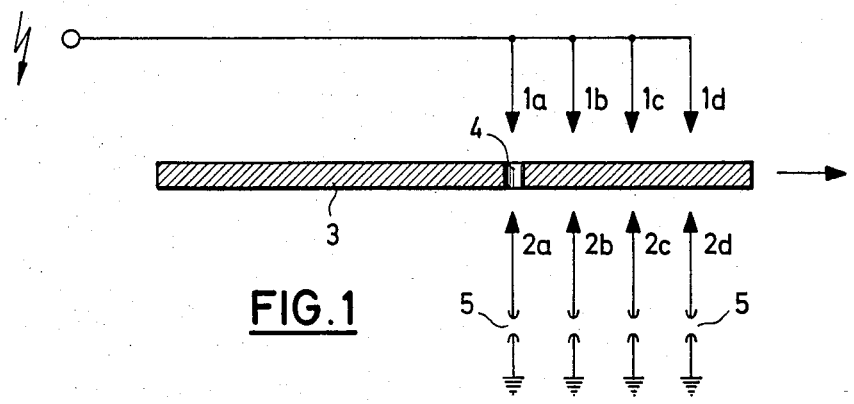
FIG. 1 illustrates a first device having a medial part for explaining the switching principle of the present invention.

In FIG. 1 a first embodiment having a medial part or a mid-portion 3 is illustrated for explaining the switching principle of the present invention. The mid-portion of FIG. 1 is a plate consisting of insulating material, like laminated paper, pertinax, epoxy resin; ceramics, or teflon. A first electrode unit 1 is arranged on the top side of the mid-portion 3, said electrode unit 1 consisting of four electrodes 1*a*, 1*b*, 1*c* and 1*d*. A second electrode unit 2 is arranged on the bottom side of the mid-portion 3, said second electrode unit 2 consisting of the electrodes 2*a*, 2*b*, 2*c*, and 2*d*, each lying opposite the electrodes of the first electrode unit 1 so that spark discharger gaps 1*a*-2*a*, 1*b*-2*b*, 1*c*-2*c*, 1*d*-2*d*, are formed. All electrodes of the electrode unit 1 are connected to each other via electric lines and are supplied with a permanent-high-voltage via a connection. Each of the electrodes of the electrode unit 1 is connected to an ignition element 5; in FIG. 1 four ignitions elements and, accordingly, four spark discharger gaps are provided. The mid-portion 3 which, for instance, consists of one of the above-mentioned isolating materials, is of such nature that it prevents a disruptive discharge between the spark discharger gaps. In addition thereto, said mid-portion 3 comprises a device 4 which is characterized in that it allows the flash-over between the electrodes of the first and the second electrode unit. This device 4, for instance, can consist of an isolating material, which has a substantially lower disruptive strength than the mid-portion 3. The device 4 preferably is a opening.

As indicated in FIG. 1 by the arrow, the mid-portion 3 is moved to the right. In this connection, the device 4 successively crosses the spark discharger gaps. Depending upon which spark discharger gap is just crossed by the device 4, a spark flashes over—as illustrated in the example—between the spark discharge gap 1*a*-2*a*. Although the other electrodes 1*b*, 1*c* and 1*d* are also supplied with the continuous-high-voltage, the high voltage flash-over cannot take place due to the mid-portion 3 which has the effect of an isolating barrier. Due to the arcing-over of the high voltage between the appertaining electrodes of the first electrode unit 1 and the second electrode unit 2, the high voltage spark and the ignition energy are transferred to the ignition elements 5. On account of the movement of the mid-portion 3 according to the arrow in FIG. 1, the spark discharge gaps 1*a*-2*a*, 1*b*-2*b*, 1*c*-2*c* are successively released.

Thus, the movement of the mid-portion 3 effects the transfer of high voltage of the individual electrodes of electrode unit 1 to the individual electrodes of electrode unit 2. Since the continuous-high-voltage is constantly applied to the electrode unit 1, the distribution of the high voltage to the individual ignition elements exclusively depends on the position of the device 4. Thus, this kind of distributing high voltage energy to the individual ignition elements is substantially easier than in the conventional system, wherein the case of need and the moment of generation coincide. The high voltage can therefore be generated according to a simple process as, for instance, known from television engineering, wherein transformers are used having a ferrite core and wherein the switching frequency lies in the range of high frequency. Such high voltage generation devices 30 are also known from switched power converters, which, due to the ferrite core and the high-frequent stimulation, have a substantial better efficiency than conventional ignition systems.

Contrary to the assumed case in which the mid-portion 3 is moved, the reversion of the principle is also possible so that the electrode units 1, 2 are moved. This reversal of the principle, i.e. whether the electrodes or the high voltage barriers are used, also applies to the following description, even if attention is not especially drawn thereto.

This simple manner of high voltage distribution to the individual ignition elements is extremely cheap and cannot be surpassed in simpleness. Moreover, it has electric properties, which cannot be achieved with a conventional electronic component part. For, the invention works as a real circuit in the high-tension circuit, additionally acts as pre-spark discharger gap, and the high-tension arc-over takes places in the range of micro-seconds which corresponds to an extremely steep voltage rise.

In the plasma-channel of the spark discharger gaps, very high current can be transferred; very high voltages are switchable with the mid-portion 3 and the device 4, and the burning time of the spark at the ignition elements is determined by the width of the device 4 and the velocity at which it is moved at the electrodes of the electrode unit 4. There is no such conventional electric circuit element having these transfer characteristics and, moreover, being so cheap.

Figure 2:
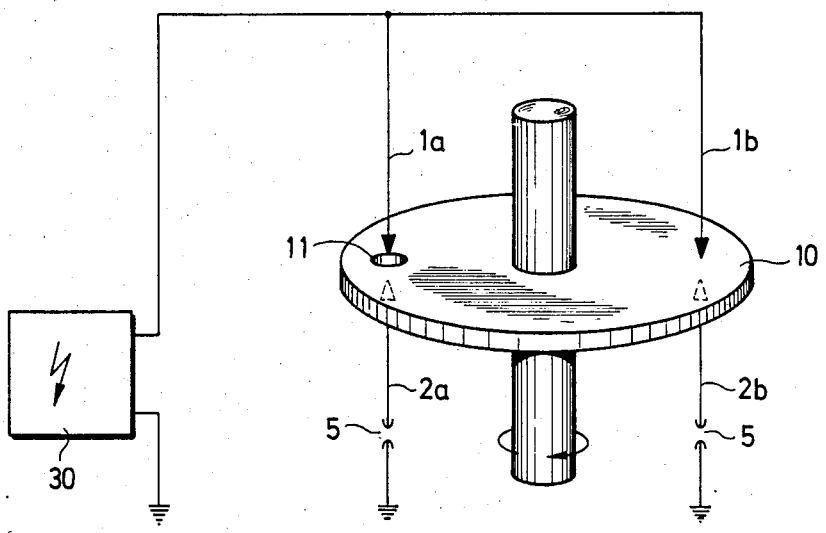
FIG. 2 illustrates a first embodiment of the invention for implementing the present invention.

FIG. 2 illustrates a first embodiment for implementing the invention. In this connection, the mid-portion 3 corresponds to the circular disc 10, which, in the centre of gyration, is tight connected to a not closer illustrated shaft being actuated to rotate by a drive which is not illustrated either. The circular disc 10 has—in accordance with the device—a opening 11 arranged at a radius such that the opening 11 crosses the spark discharger gaps of the first and the second electrode units, respectively, when the circular disc 10 is rotating. The upper electrodes of the first electrode unit 1 are commonly supplied with the permanent-high-voltage of the high voltage generating device 30. The electrode units 2 are separately connected with the ignition elements. For the sake of simplicity, only two spark discharger gaps and two ignition elements have been illustrated in FIG. 2. Due to the rotation of the circular disc 10, the opening 11 crosses periodically the spark discharger gaps, thus transferring the high voltage to the one or to the other ignition element each time when the circular disc 10 is rotated by 180° according to the example illustrated in FIG. 2.

Figure 3:
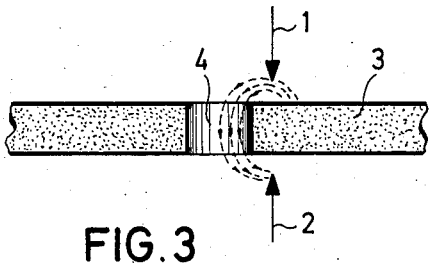
FIG. 3 illustrates a detail cut-out of the opening of the device according to FIG. 1.

FIG. 3 illustrates a detail cut-out of a device 4 or a opening 11. This detail cut-out shown in FIG. 3 should make clear that the flux lines, which flow from the one electrode of first electrode unit 1 to the appertaining electrode of the second electrode unit 2 or which flow between the electrodes, do not necessarily flow rectilinearly. The flux lines prepare the ionization of the spark discharger gaps so that the plasma channel can be formed. The consequence of the curved course of the flux lines is the characteristic that the flux lines "can feel around the corner". Hence follows that the spark-over can take place even before the mid-portion opens the shortest distance between the electrodes. The accuracy of the moment of the spark-over is sufficient for many cases of application, since the spark-over takes place in the micro-second range, however, it is desirable—just to fulfil the requirements of an ignition system—to determine more exactly the spark-over time point in an internal combustion engine in order to reduce the emission of noxious substances.

Figure 4:
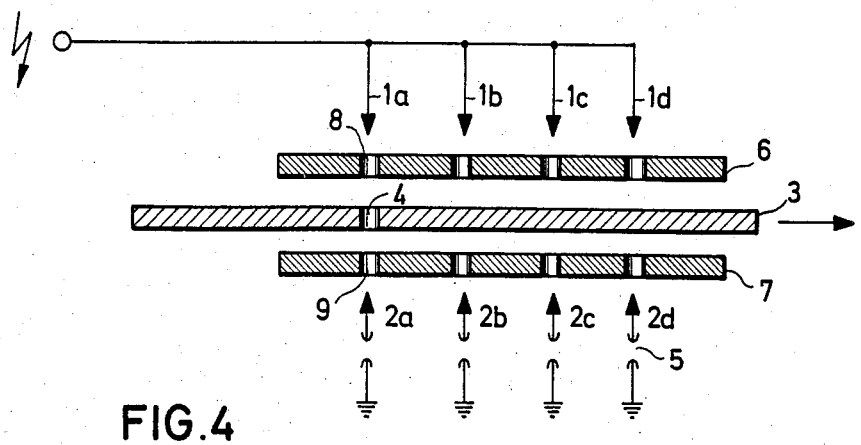
FIG. 4 illustrates a second device comprising a medial part and two lateral parts for explaining a further switching principle of the present invention.

FIG. 4, in principle, illustrates a second device, by means of which the high voltage is transferred to the individual ignition elements, one after the other; however, this device has a more exact switching behaviour and avoids the problems mentioned under FIG. 3 or the "blowing away" of the plasma channel. The device according to FIG. 4 has the same components like FIG. 1, except for two parts; therefore, the identical components with regard to FIG. 1 are provided with the same reference numerals and are not described again. On both sides of the mid-portion 3, lateral parts 6 and 7 are spaced apart from each other in the spark discharger gaps of the electrodes of the first and second electrode units 1 and 2. In the example illustrated in FIG. 4 the lateral parts are not moved. In the spark discharger gaps of the individual electrodes, each lateral part 6, 7 has a number of devices 8, 9 corresponding to the spark discharger gaps. The devices 8, 9 are preferably openings.

Figure 5:
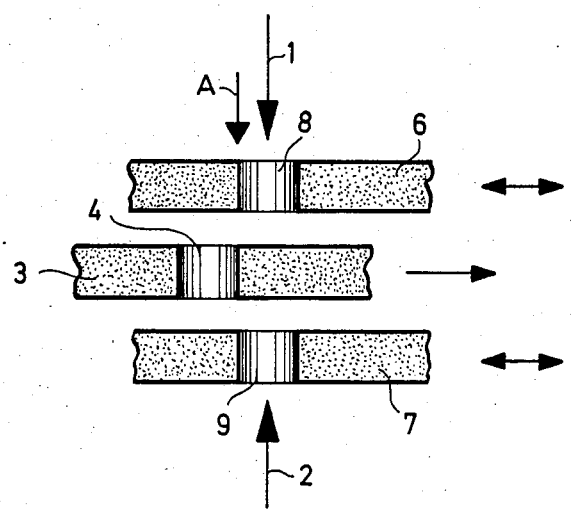
FIG. 5 illustrates a detail cut-out of several openings of the device according to FIG. 4.

By means of the detail cut-out of several openings from the device shown in FIG. 4, which is illustrated in FIG. 5, the switching characteristic of the device of FIG. 4 will be explained in the following. In this connection, the mid-portion 3 with its device 4, i.e. opening 11, is illustrated such that the front edge of the mid-portion 3 coincides with the rear edge of the devices 8 and 9, being openings, of the lateral sides 6 and 7. The diameters of the openings 8 and 9 of the lateral parts 6 and 7 are of equal size and are exactly facing each other. Even if the openings 8 and 9 are illustrated equally-sized, it is possible to choose different diameters for the openings 8 and 9. Furthermore, the openings 8 and 9 need not coincide exactly in the other embodiments and can be laterally displaced against each other with regard to the moving direction of the mid-portion. At the front edge of the openings depending upon the moving direction of the mid-portion 3, a mark "A" is provided. The opening 8 and 9 are symmetrically arranged about the spark discharger gap, which is formed between an electrode 1*a* and an electrode 2*a* of the electrode units 1 and 2. For example, the electrode 1*a* is supplied with the continuous-high-voltage. The electrode 2*a* is connected with an ignition element 5.

As long as the massive area of the mid-portion 3 still lies between the disruptive discharges 8 and 9, the flux lines, which, e.g., start from the electrode 1*a*, cannot reach the electrode 2*a*, because the massive area of the mid-portion 3 acts as an isolation barrer. Thus, no plasma channel can be formed, for the flux lines cannot ionize the entire spark discharger gap. In the illustrated position of the mid-portion 3 with the opening 4, only those marginal flux lines, which run along the front edge of the opening 4, can reach the electrode 2*a*. By moving the opening 4 further to the right, as shown in FIG. 5, more and more flux lines flow from the electrode 1*a* to the electrode 2*a*. Due to the further movement of the opening 4 to the right, the section for the flux lines is more and more opened to the flux lines. From a determined opening degree onwards, the flux lines are enabled to ionize the spark discharger gap, and the plasma channel is formed, whereby the high-voltage energy is transferred to the ignition element 5. The opening of the spark discharger channel via the disruptive discharge 4 depends on the position of the electrodes with reference to the rear edge of the disruptive discharges 8 and 9, at which the mark "A" is shown. The disruptive characteristic also depends on the position of the electrodes 1*a* and 2*a*, which may possibly be laterally displaced. The height of the high voltage determines the disruptive discharge. Furthermore, since the discharge ensues essentially in the microsecond range, the relations are always the same and the discharge takes place at small opening gaps the moment of arcing-over—and therefore the firing point—is essentially constant. The constancy of the firing point is favourably supported by the relation of the disruptive characteristic in the micro-second range to the sequence of the ignition time points, since the disruptive discharge takes place a thousand times faster than the firing points succeed one another. This constancy was also confirmed by measurements.

Although there is always provided an air gap between the mid-portion 3 and the lateral parts 6, 7, the above-mentioned parts can also slide on each other.

Thus, the ignition time point is determined by coinciding the rear edges of the openings 8 and 9 (mark "A") with the front edges of the opening 4. Due to the fast disruptive discharge in the micro-second range, the result is a very steep rise time for the high voltage at the ignition element 5. The spark burning time is thereby substantially determined by the period of time, in which the mid-portion 3 moves by the path length, which results from the diameter or the gap spacing of the opening 4 and the gap spacing of the opening 8 or 9.

Due to the further movement of the opening 4, the transmission band of the channel between the rear edge of the disruptive discharge 4 and the front edges of the openings 8 and 9 is more and more "throttled". The edges are not directly exposed to the extremely hot plasma channel, since the flux lines surround the plasma channel. Thus, first of all, the flux lines are throttled, and due to the throttling of the flux lines, the plasma channel is deprived of its basis of existence. From a certain degree onwards, the transmission channel for the flux lines was limited so far that the plasma channel comes to a dead stop. Thus, the ignition is interrupted because the flux lines are—so to say—sheared off and can flow right-angled only under extreme difficulties. In order to further maintain the plasma channel, the flux lines ought to flow multiple-rectangularly. This way would be composed of flowing through a straight piece on the axis between the lateral part and the mid-portion 3, then flowing through a short piece right-angled to the axis to the right, further flowing through a larger piece parallel to the axis through the disruptive discharge 4, then flowing through a short piece right-angled to the axis to the left and through a last straight piece on the axis to the electrode 2*a*.

Such a course of the flux lines could only be achieved with extremely high intensities, which do not occur in the present ignition system, and therefore, the device illustrated in FIG. 5 shows an excellent switching characteristic, wherein the firing point results from the edges of the lateral parts marked with the mark "A" and the spark burning time results from the period of time of passing the gap spacings. Furthermore, a "blowing away" of the plasma channel is not possible.

It is also easily possibly by means of the present invention to vary the firing point by shifting the lateral parts 6 and 7 with reference to the mark "A". With the assumed movement of the mid-portion 3 to the right, a movement of the lateral parts 6 and 7 to the left would antedate the firing point, and a movement to the right would have the effect that the firing point takes place later. Furthermore, the number of disruptive discharges can be easily achieved by increasing the number of the openings in the lateral parts 6, 7 of in the mid-portion 3. By this, for example, two ignition elements provided at different positions in a piston capacity could be supplied with ignition energy in most different manners. Due to the great number of variation possibilities and despite the increase in the air proportion, the inflammability of the fuel-air mixture can thus be achieved in an easier manner, thus reducing the emission of noxious substances. In addition thereto, the numerous variation possibilities allow the adaptation to most different internal combustion engines as well as to most different fuels. In all cases, it is favourable that optional portions can be chosen from the continuous-high-voltage at optional time points.

An ignition system according to the present invention therefore has the additional advantage that, compared to conventional ignition systems with the problem of generating high voltage, which arises due to the continuous generation of high voltage at the firing point, and the coincides with the ignition time point, are eliminated. Moreover, the invention has the transfer function of a circuit for high voltage with switch-over times lying in the micro-second range. Besides, the probability of the inflammability is enlargend, because the steep edges additionally evaporate the mixture, and the remaining spark is inflammed.

Although in FIG. 5 a device, comprising a mid-portion 3 and two lateral parts 6 and 7, is described, other devices are possible, comprising e.g. one lateral part or several, alternately superimposed lateral parts and mid-portions.

Figure 6:
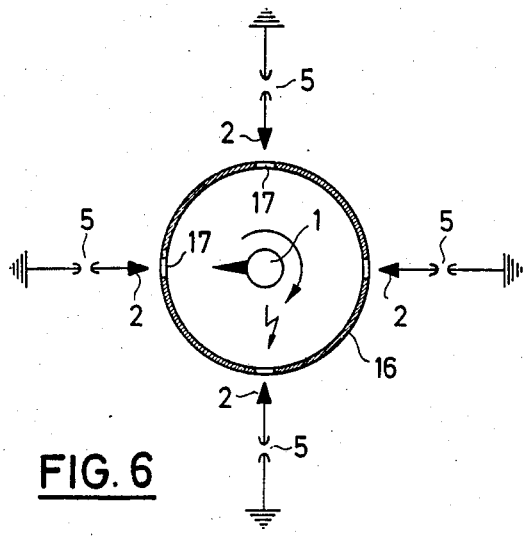
FIG. 6 illustrates a second embodiment for implementing the invention.

FIG. 6 shows a second embodiment for implementing the invention. There, the mid-portion 3 is formed as the tube section 16, comprising a number of openings 17 corresponding to the ignition elements 5. In the center of said tube section 16, the first electrode unit 1 rotates being supplied with the high voltage. The electrode unit 1 lies in a plane, in which the openings 17 are provided in the tube section 16. Outside said tube section 16, the electrodes of the electrode unit 2 are arranged in front of the opening charges 17. When the first electrode unit rotates on a (not illustrated) shaft, the electrode unit 1 successively passes through the sequence of the opening 17 in accordance with the rotation direction and transfers the high voltage to the ignition elements 5 in the above-mentioned manner and similar to FIG. 2.

Deviating from the embodiment illustrated in FIG. 6, it is possible to arrange several electrodes of the electrode unit 1 along the axis. This embodiment provides further openings and electrodes of the electrode unit 2 in that plane, in which the further electrode of the electrode unit 1 moves.

Figure 7:
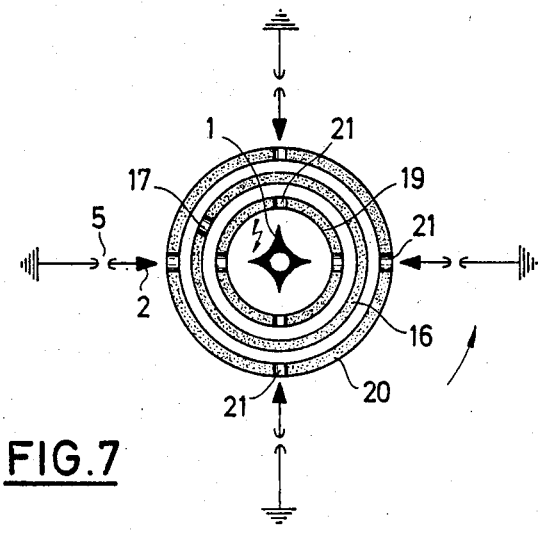
FIG. 7 illustrates a third embodiment for implementing the invention.

FIG. 7 describes a further embodiment having tube sections, in which, however, the first electrode unit 1 is not moved, and which comprises e.g. four electrodes, which are arranged to each other in an angle of 90° and are directed darially outwards. In addition thereto, the electrodes of the first electrode unit 1 are arranged in a plane. The first electrode unit 1 is surrounded by an inner lateral tube section 19, which has also openings 21 in the plane of the electrode unit 1, said openings facing the electrodes of the electrode unit 1. Furthermore, the lateral tube section 19 is surrounded by a further tube section having a larger diameter, which is the only part moved in this embodiment. The tube section 16 additionally shows a opening 17, which is provided in the plane of the opening 21 and the electrodes of the electrode unit 1.

Finally, a lateral tube section 20 is surrounding the afore-mentioned parts. The outer lateral tube section 20 has—like the inner lateral tube section 19—a number of openings 21 corresponding to the number of ignition elements, said openings also lying in the plane of the electrode unit 1. All aforementioned parts having different radia thus are coacially positioned on an assumed axis, along which the electrodes of the first electrode unit 1 are arranged, e.g. at angles of 90°. Furthermore, all openings are arranged in a plane which is determined by the electrodes of the electrode unit 1.

The openings 21 of the outer and inner lateral tube sections 19 and 20 are also positioned on the radial axes, which are strained over by the electrodes of the first electrode unit 1. The electrodes of the second electrode unit 1 additionally are positioned on these radial axes, in direction to the electrodes of the first electrode unit 1 in front of the openings of the outer lateral tube section 20. The electrodes of the second electrode unit 2 are thereby connected to the ignition elements 5. When high voltage is supplied to the first electrode unit 1, the transmission channel is opened due to the rotating middle tube section 15, having the opening 17, in accordance with the explanations with regard to FIG. 5. Deviating from the explanations with respect to FIG. 5, the mid-portion 3, which corresponds to tube section 16, and the lateral parts 6, 7 which correspond to lateral tube sections 19 and 20, are curved and not plane.

Figure 8:
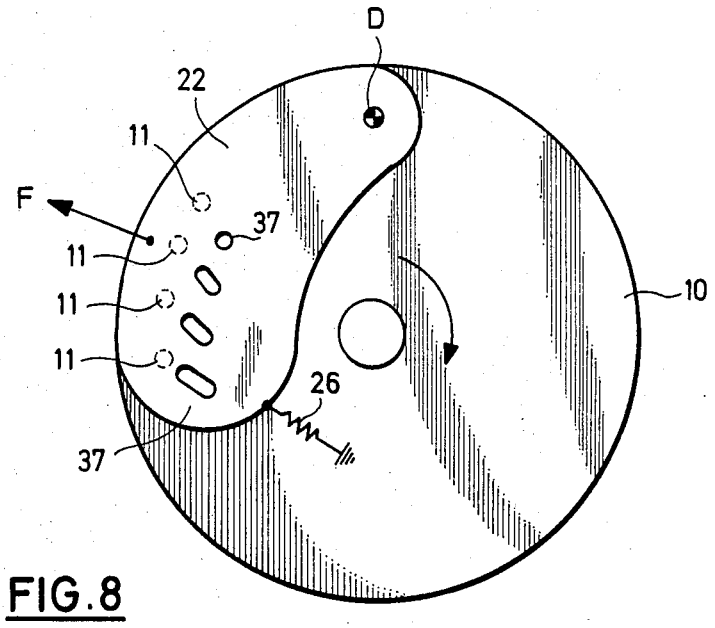
FIG. 8 illustrates a centrifugally-dependent portion for opening and closing the openings.

FIG. 8 illustrates a centrifugally-dependent part 22 for opening and closing several openings 11 in the circular disc 10. The centrifugally-dependent part 22 is reniformly bent and adapted to the external margin of the disc 10 and is left vacant in the centre part of the disc 10, where the (not illustrated) axis is mounted. At the one end, centrifugally—dependent part 22 is additionally tapered, and said end is mounted at point D being also the center of gyration. The centrifugally—dependent part 22 planely resting on the circular disc 10 is pulled by means of reset spring 26, which engages the other end opposite the center of gyration, against a (not shown) stop to the center point of the disc 10. The Disc 10 comprises several openings 11 (indicated by a dotted line), which are positioned at the same radius, and are arranged tandem at determed distances. An equal number of openings 37 are formed in the centrifugally-dependent part 22. Reffering to the center point of the circular disc 10, the openings 37 are formed at certain successive angles and different radia. The radius and the distances of the openings 11 and angles and radia of the openings 37 are adjusted to each other such that one pair of the opening 11 and 37 each coincides successively when the centrifugally-dependent parts move outwardly against the spring force of the reset spring 26. The same number of openings 37 compared to the openings 11 rotates around the center of gyration D on different orbits, ant the first openings 37 which coincide with the appertaining openings 11, show the largest opening in the direction of its orbit. The remaining opening 37 are positioned at their corresponding radia around the center of gyration and also show correspondingly shorter, curved, and lengthy openings.

If the circular disc 10 is, for example, rotated to the right, the centrifugally-dependent part 22 is pressed outwards due to the centrifugal force. In this connection, the first pair of openings 11, 37 is brought to coincidence, whereby this is that opening with the longest, bent opening 37. The length of the opening 37 is tuned such that all disruptive discharge channels provided between the centrifugally-dependent part 22, which is also an isolating part, and the circular disc 10 are opened. Thus, in response to the rotational speed, a different pulse sequence can be supplied to the ignition elements. The openings 11 and 37 can also be arranged in a different manner in order to achieve other disruptive discharge sequences in response to the rotational speed.

However, if the circular disc 10 stands still (is not rotating), all disruptive discharge channels are closed. The advantage thereof is that, when the internal combustion engine or the motor stands still, which drives the circular disc 10, no high voltage is transferred from the one electrode unit to the other electrode unit, an that a disruptive discharge channel does not open by chance a spark discharger gap when the internal combustion engine stands still.

Figure 9:
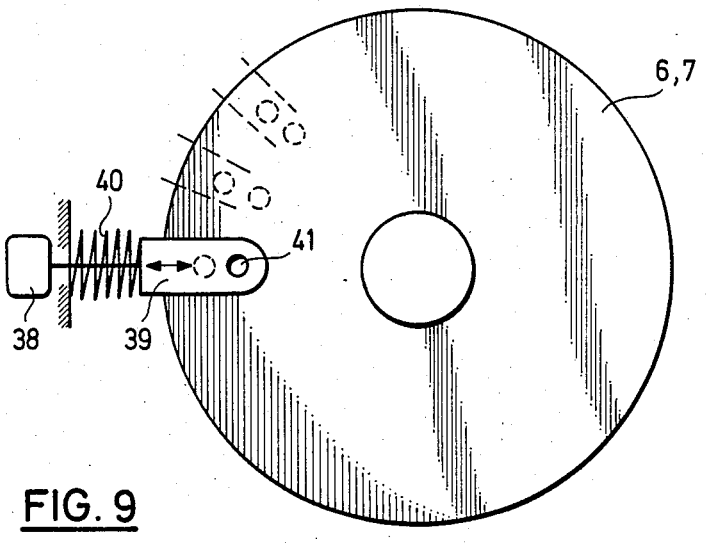
FIG. 9 illustrates electromechanically operated portions for opening and closing said openings.

FIG. 9 illustrates an electromechanically operated part 39 for opening and closing the openings. The electromechanically operated part is preferably used for the less moved lateral parts 6 and 7. Contrary to this, the centrifugally-dependent part 22 is preferably used for opening and closing the disruptive discharges provided in the circular disc 10. The reference numeral 38 in FIG. 9 characterizes an electromechanical drive 38, e.g., a relay or a small solenoid. The electromechanically operated part 39 is, for instance, a slider which is moved radially outwards by means of the drive 38 against the impact of the force of a spring 40. The part 39 has a opening 41, which coincides with the opening 15 due to the movement of the slider 39. As indicated by dotted lines, several sliders can be radially arranged under different angles. The drive 38 is stimulated by a (not illustrated) control device to move the slider 39. Thus, depending upon the ignition demand, the opening 15 provided in the lateral part 6, 7 can be opened or closed.

Deviating from the above-described statements, wherein the spark burning time depends on the rotational speed, of e.g., the circular disc 10, it is easily possibly with the present invention to keep the spark burning time constant via the rotational speed. In this connection, only the length of the openings provided in the lateral parts or in the circular disc 10 has to be enlargened so that the entire way resulting from both openings is enlargened. By varying the length of the openings, the spark burning time can be adapted to the rotational speed.

Figure 10:
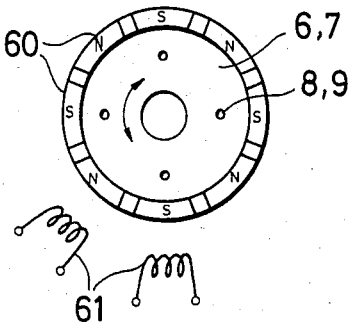
FIG. 10 illustrates a shifting principle, wherein said lateral parts are components of a servomotor.
Figure 11:
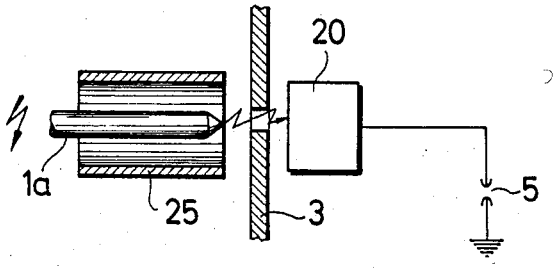
FIG. 11 illustrates an arrangement of electrode units in a cylinder consisting of isolating material.

FIG. 10 shows a timing principle in which the lateral parts for controlling the firing points are components of a motor. Since the result of the operating data of the internal combustion engine are most different firing points, said firing points must be quickly varied. Although the lateral parts 6, 7 and the lateral tube sections 19, 20 provided for controlling the firing points can be operated by a conventional vacuum spark advance, the invention can be easily used to shift the firing points by means of a motor, the lateral parts 6, 7 or the lateral tube sections 19, 20 being components of said motor. Due to the low mass of the lateral parts or of the lateral tube sections, the controlling can be easily performed. As illustrated in FIG. 10, in principle, the lateral parts 6, 7 have, for example, magnets 60 provided at their outer periphery, said magnets 60 being applied in response to the externally arranged field windings 61 and rotating the lateral parts 6, 7 around (not illustrated) bearing elements. Depending upon the case of application of determined internal combustion engines, different motors like, for example, linear motors, servomotors, etc. can be used. As illustrated in FIG. 11, an electrode 1*a* of the first electrode unit 1 is arranged in an insultant cylinder 25. If, for instance, said electrode 1*a* is supplied with high voltage, said cylinder 25 influences the course of the field lines starting from the electrode 1*a*. The cylinder 25 effects that the disruptive discharge takes place at a high voltage with a lower level. By shifting the cylinder along its axis, the projection of the electrode 1*a* can be varied, thus varying the disruptive voltage.

The disruptive voltage can also be varied by changing the position of the mid-portion 3 along the spark discharger gap between the electrode 1*a* and the electrode 2*a*. Although the mid-portion 3 and the corresponding parts are always arranged in the middle of the spark discharger gap in the embodiments, it is possible to vary the length position of the mid-portion 3 and to determine it differently.

As is further illustrated in FIG. 11, the electrode 1*a* has a tip and the electrode 2*a* has a plane surface, to which the tip of said electrode 1*a* is directed.

By means of this electrode arrangement, the disruptive voltage can be reduced, especially when direct voltage is supplied to electrode 1*a*. Depending upon the type of the supplied high voltage, the configuration of the electrodes can consist of combinations of tip, plate, ball and curve form lying therebetween. The electrode 2*a* can also be arranged in an insulant cylinder, whereby the cylinders 25 can take over the function of the lateral parts.

FIG. 12 illustrates several forms of the openings provided in the mid-portion 3 or in the lateral parts 6, 7. In FIG. 12A, the opening—with respect to its moving direction—shows a separating nose for better cutting and influencing the flux lines and the plasma channel. In FIG. 12B, an edge, which is stronger subjected to stress, is provided with a high-voltage-and-plasma-channel-resisting material, like, e.g., porcelain.

Figure 12A:
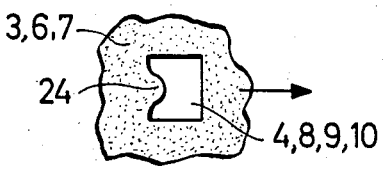
FIGS. 12A, 12B, 12C and 12D illustrate different embodiments of edges of said openings.
Figure 12C:
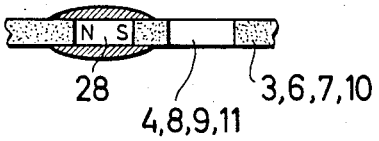
Figure 12B:
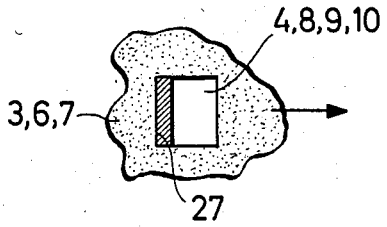

In FIG. 12C, for example, a magnet 28 is arranged in the area of a opening insulated from the high voltage. By an appropriate selection of the flux line course of the magnet, the cutting-off of the plasma channel can be supported. For instance, the maget 28 can be arranged in the circular disc 10 behind the opening 11, with regard to the moving direction, thus pushing away the flux lines surrounding the plasma channel when they are flowing towards the plasma channel.

Figure 12D:
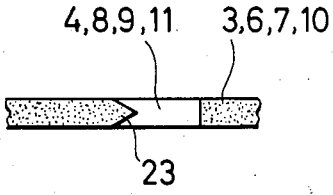

FIG. 12D illustrates a opening comprising a tapered edge 23 separating the plasma channel. The other edges of the disruptive discharges can also have appropriate shapes, like taperings or rounding-offs. By means of these taperings, the course of the flux lines is changed in the disruptive channel and can be easily influenced, and the edges are more stable, and preionizations can be achieved.

Figure 13:
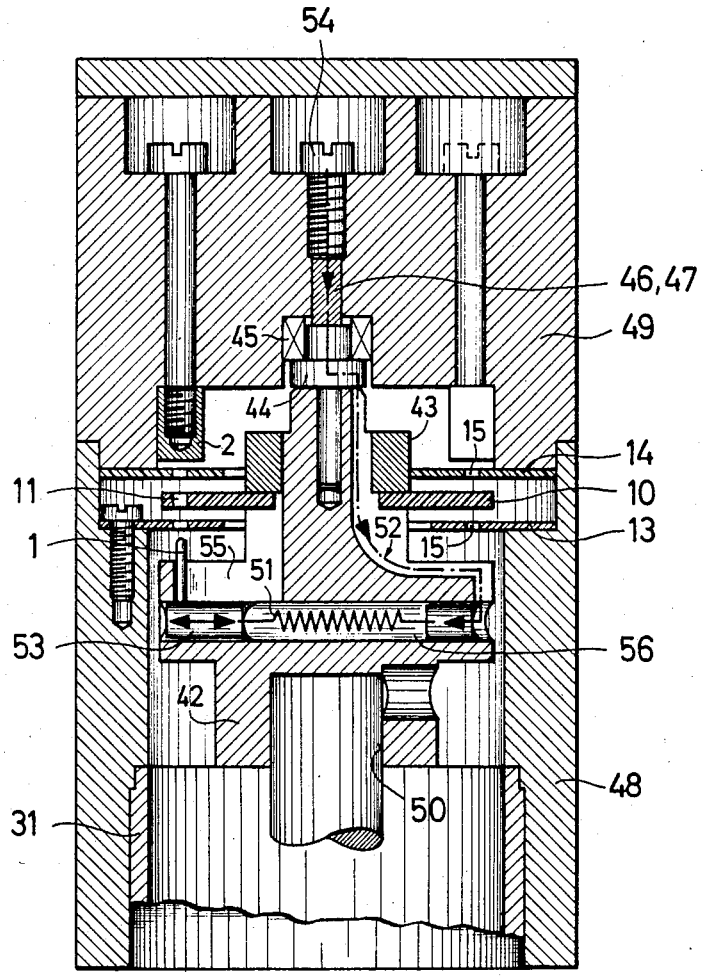
FIG. 13 illustrates a concrete embodiment for implementing the invention.

FIG. 13 is a concrete embodiment for implementing the present invention. In this connection, a carrier 42 for the circular disc 10 having a bore-hole 50 is put up on the axis of the spark-over distributor 31 like a conventional rotor. Said carrier 42 is a round rotary body and is mounted to the axis of the spark-over distributor 31 in a suitable manner against twisting.

In addition thereto, a lower part 48 is put up on the spark-over distributor 31, said lower part 48 carrying a lower lateral disc 13 being mounted to said lower part by plastic screws. In this connection, the lower lateral disc 13 is arranged around (1 mm) below the circular disc 10.

An upper part 49, which also is mounted to a lateral disc 14 by means of plastic screws, is put up on said lower part 48. The upper lateral disc 14 is arranged at about (1 mm) (0.039 in) above the circular disc 10. A bore-hole is provided in the centres of the lateral discs 13 and 14 so that the carrier 42 can unhamperedly rotate with the nut 43. In addition thereto, in the upper part of a ring nut, for example, four electrodes of the second electrode unit are arranged at angles of 90°. Not illustrated insulating pieces are provided between the electrodes. The electrodes of electrode unit 2 are positioned at about (1 mm) (0.039 in) above a opening 15 provided in the upper lateral disc 14. Openings 15 are also provided in the lower lateral disc 13 surrounding the axis of the carrier on the same radius and lying on an axis parallel to the carrier 42. The opening 11 provided in the circular disc 10 is also lying on this radius.

A radial gap 55 is provided in the carrier 42, in which a single electrode of the first electrode unit 1 can move radially outwards. The electrode of the first electrode unit 1 can move radially outwards up to the radius, at which the electrodes of the second electrode unit are provided. In addition thereto, a transverse bore-hole 56 is provided in the carrier 42, whereby the length of the gap 55 corresponds to a straight-through cavity with regard to the transverse bore-hole 56. Said transverse bore-hole 56 contains a movable bolt 53, in which the electrode of the first electrode unit 1 is screwed, and which is connected to a tension spring 51 with its internally directed end. Said tension spring 51 is connected to a screw screwed to the opposite end of the opening of the transverse bore-hole 56.

Due to the centrifugal forces, during the rotation of the carrier 42, the bolt 53 comprising the electrode is radially moved outwards until the electrode is located at the radius of the opening 15. Furthermore, the carrier 42 comprises a bearing 44 the high voltage of which is supplied from above via a carbon 46 from a terminal provided in the upper part. The bearing 44 rotates in a ring 45 mounted at the upper part. A cable 52 extends in a not closer designated groove between the bearing 44, which, at same time, serves as terminal, and the screw screwed in a transverse bore-hole 56. If, due to the centrifugal force, the electrode of the first electrode unit is positioned at the state or at the corresponding radius there are provided at every 90°—because of the present openings at every 90°—spark discharge gaps which are released by the opening 11 at every 90° when the circular disc 10 is rotated.

The continuous high voltage which is produced in a not shown device is supplied to the carbon 46 positioned on the centerline of the carrier 42 via the bearing 44 and the cable 52 to the screw 54. From this position, the high voltage is supplied via the tension spring 51 to the bolt 53 and, finally, to the electrode of the first electrode unit. If the carrier 42 is rotated, the electrode of the first electrode unit 1 will reach its working position, at which the opening 11 of the circular disc 10 and the electrodes of the electrode unit 1 in the working position are in alignement. If the spark gap is released by rotating the carrier 42, the high voltage sparks over the opening 15 of the lower lateral disc 13 and the opening 15 of the upper lateral disc 14. Finally, the high voltage or the lines of flux reach the electrode of the second electrode unit 2, from which the high voltage is supplied to the ignition elements.

The movability of the electrode of the first electrode unit 1 in radial direction to the working position by ratation the carrier 42 has the advantage that, when the internal-combustion engine stops the spark gap is interrupted, i.e., no flash-over can take place between the first and second electrode unit when the opening 11 of the circular disc 10 should accidentally release a discharge channel. Only at an adequate rotation the electrode of the first electrode unit 1 reaches the working position due to the centrifugal force. The electrodes can thus be protected against strong heating up during the stop of the engine. This heating up is avoided by the movement of electrode of the first electrode unit 1. Furthermore, the electrode is cooled by the passing air. Likewise turbine blades of a fan can be mounted at the carrier 42 in order to provide a sufficient turbulence.

The transfer of the high voltage or more exactly the selection of high voltage pulses from the continuous high voltage is only obtained in this embodiment by rotating the circular disc 10 and one electrode which is in alignement with the opening 11 of the circular disc 10 in its working position and which, at stoppage, is pulled off radially, inwards from the opening 11, so that a further flash-over of the high voltage is prevented. In addition thereto, the lower part 48 can be rotated on the distributor 31 whereby, due to the deviation of position, of the openings 15 of the lower and upper lateral disc 13 and 14, the ignition time point can be adjusted. After the adjustment of the ignition time point the lower part 48 is fastened to the distributor 31.

Deviating from this embodiment, the upper and lower parts 48, 49 can be made of two half-shells, which are gasproofly closed, in which the unit for implementing the process is accomodated in the same manner as described above. By this, the disruptive voltage can be varied due to the Paschen's law by the air pressure within the upper part and the lower part 48, 49.

Figure 14:
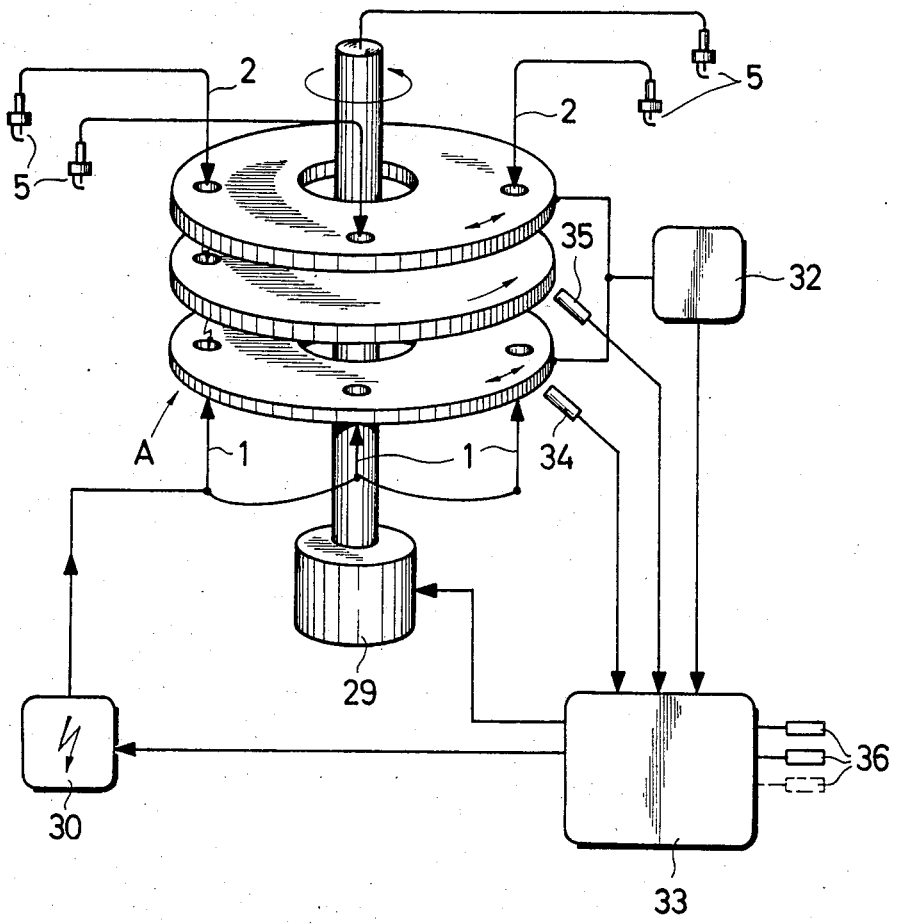
FIG. 14 illustrates an example of the ignition system into which the invention is integrated.

Although it is not closer described, all embodiments of the invention comprise noise suppressions in the shape of outer cases of metal and noise suppression proceedings. FIG. 14 shows a complete ignition system in which the invention is integrated as an essential component. The invention is driven by an external motor 29 and not—as described before—by the distributor shaft of the internal combustion engine. The rotationel speed of motor 29 is controlled by a control system 33, which could be a microprocessor. The control system detects the operational data of the internal combustion engine by sensors 36. Furthermore, the control system 33 receives via sensors 34, 35 the positions of the lateral parts 6, 7 and the mid-portion 3. Additionally, the control system 33 controls an ignition control device 32. The ignition control device 32 can be an unit as described under FIG. 10. The electrodes of the first electrode unit 1 are supplied with the high voltage from a high voltage generating device 30 in known manner. The electrodes of the second electrode unit 2 are connected with the ignition elements 5. The data which are supplied to the control system 33 by the sensor 34, 35 and 36, are used by the control system 33 to control and regulate the speed of the engine motor 29, the ignition control device 32 and thus the point of ignition of the internal combustion engine. Additionally the control system 33 can trigger other devices—e.g., as described under FIGS. 8, 9 or 10—as well as the high voltage generating device 30.

Figure 15:
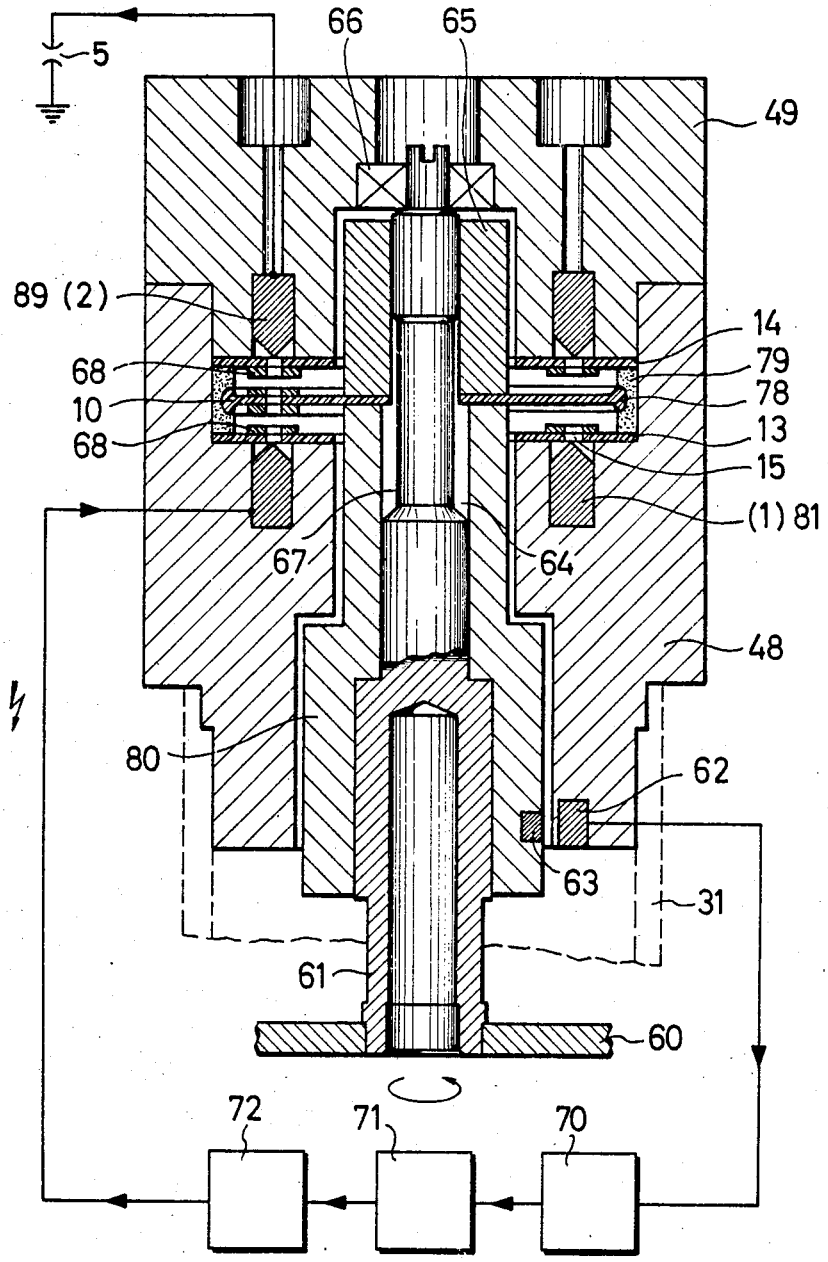
FIG. 15 illustrates a second concrete embodiment for implementing the invention.

In comparison with FIG. 13, FIG. 15 shows a further concrete embodiment which, however, does not comprise a moved electrode unit 1. The electrode unit 1 is formed as an electrode ring 81 which is located in a ring groove provided in the lower part 48. The electrode ring 81 consists, e.g., of brass and its tip is directed to the tips of the electrode unit 2 or 89, respectively. Four electrodes 89 are provided for a four-cylinder internal combustion engine, the electrodes 89 having the same cross section as the electrode ring 81. Therefore, the electrodes 89 can be manufactured by cutting up the electrode ring 81 so that the fabrication is simplified. The electrodes 89 are located in single, spaced apart groove sections of the upper part 49 and are mounted in the upper part 49 by screws, which are not shown. The screws extend from the electrodes 89—which comprise a corresponding screw thread—to nuts provided at the upper side of the upper part 49. Ignition leads disposed within the nuts are supplied to the spark plugs. Additionally to the fastening of the electrodes 89, the screws take over the function to conduct the transferred high voltage to the ignition leads. In order to do this, the ends of the ignition leads comprise cable terminals which are mounted to the screws. Due to the fact that the electrodes 89 are located in single groove sections, they are insulated against each other. The groove sections extend, e.g., over an angle range of 40°. The remaining material of the upper part 49 thus constitutes partitions, the upper and lower parts 49, 48, are, of course, consisting of synthetic material. The electrodes 84 are arranged opposite the electrode ring 81 forming tip-tip sparking gaps. In order to guarantee a disruptive breakdown corresponding to the form of the electrodes, the selection of the configuration of the electrodes depends—as described above—on the category of the continuous high voltage, (AC or DC). For example the electrodes 89 could also be plane thus forming a tip-plate sparking gap with the electrode ring 81.

The continuous high voltage is supplied from a high voltage device 72 to the electrode ring 81. Hence results the advantage that no carbon brush 46 is necessary like in FIG. 13. Furthermore, the design of the bearing and of the insulation of the elecrode unit 1 is more simplified by means of the inserted electrode ring 81. However, compared to FIG. 13, leakage distances can be easier formed; the provision of flux lines along the entire electrode ring 81 requires more energy than necessary at the punctual electrode unit 1 in FIG. 13. Nevertheless, the embodiment in FIG. 15 offers advantages, like, that there is less mechanical expenditure, e.g., since the carrier 42 is not necessary.

Figure 20:
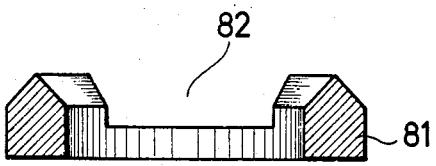
FIG. 20 illustrates a cross sectional view of a lower electrode ring and a view from above.
Figure 21A:
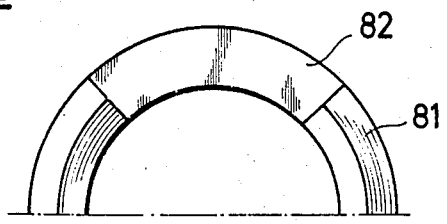
FIG. 21A illustrates an electrode segment having needle electrodes.
Figure 21A:
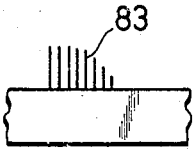
Figure 21B:
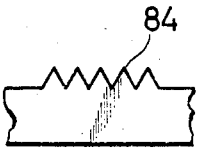
FIG. 21B illustrates an electrode segment with toothed electrodes.

As shown in FIG. 20, the electrode ring 81 may comprise recesses 82 for reducing the danger of leakage distances, said recesses simultaneously contributing to the reduction of flux lines generating over the entire electrode ring 81. Thus preferably only one arc field develops in that section where an arc-discharge is to take place. For further concentrating the flux lines at definite points, a row of needles 83 or teeth 84 (FIG. 21A and FIG. 21B) can be provided instead of the continuous tip. Said needles 83 or teeth 84 can simultaneously also replace the lengthy electrode tip provided at said electrodes 89, as shown in FIG. 21A, the needles 83 and teeth 84 can be inclined in height in this direction, in which the last disruptive discharge to take place, whereby th cutting-off and the interruption of the disruptive discharge is improved. Furthermore, due to the needles 83 and teeth 84, it is also achieved that the disruptive discharge is interrupted for a short period of time when the breakdown channel jumps from one tooth to the other. This successive passing through the needle and tooth tips is also supported by the decrease at the tip height in direction of the last breakdown and by the movement of the circular disc 10 comprising the opening 11. Therefore, the trailing edge of the opening 11 shifts the flux lines, as described in detail with regard to FIG. 5. Due to the jumping over to the next tip, the interruption is continued up to the spark plug 5, so that the interaction of the plasma channel to the gas molecules is increased. Thus, it is easily possible to generate multiple sparks successively following each other within a short period of time. In order to guarantee the jumping-over, the interspaces provided between the needles 83 and the teeth 84, respectively, could be filled with insulating material.

Especially in the case of four-cylinder internal combustion engines, it is possible to manufacture eight individual electrodes from a single electrode ring 81. Four pieces thereof can be used for electrodes 89 and the remaining four pieces thereof can be connected to form a ring by means of shorting bars. Together with the recesses—as the recesses 82—the shorting bars, e.g., in the form of soldered strong wires can be covered with insulating material. Likewise it is possible to manufacture the electrodes 89 and the electrode ring 81 from stripes of sheet metal, whereby the recesses 82, the needles 83 and the teeth 84 are punched out. Finally, the stripes of sheet metal are bended to the corresponding circular arc-curvature. In order to mount the electrodes 89 consisting of stripes of sheet metal, thread bows were worked out by laterally bending out or deformation. The electrode ring 81 is located in the groove in the lower part 48 by being imbedded in silicon paste or cemented in silicon paste.

The upper part 49 in FIG. 15 is set up on the lower part 48, whereby the height of the portion of the upper part 49, which is inserted into the lower part 48, is dimensioned such that there remains an adequate distance for the lateral discs 13, 14 and the circular disc 10. This distance amounts, e.g., to 0.236 in (6 mm). The lateral discs 13 and 14 are mounted at the upper part 49 and the lower part 48, respectively, by means of plastic screws and plastic snap rings. The embodiment of FIG. 15 does without an automatic control of the firing point, e.g., by the vacuum spark advance. Therefore, the lateral discs are rigidly fixed at the upper and lower parts 49, 48. However, the lateral discs can also be positioned rotatably and coupled to each other; thus they can be used for the regulation of the firing point. In this connection, the different data of the engine can be evaluated by a micro-processor, which controls the regulation of the lateral discs 13, 14. In this case, the lateral discs are preferably connected to each other by means of an intermediate ring comprising, e.g., at the outer periphery, a toothing engaged by a servomotor controlled by the microprocessor. As in FIG. 10, e.g., magnets can be inserted into the intermediate ring, said magnets forming together with control coils a stepping motor.

In the center of the circular upper and lower parts 48, 49 corresponding borings are provided to take up a shaft 61, a lower plastic screw 80, an upper plastic screw 65 and a bearing 66. The distances of the electrodes 80, 81 to the single metal parts 61,66 are dimensioned such that disruptive discharge as long as possible and long surface-leakage pathes occur which "go around corners". The shaft 61 is connected to the carrier plate 60 for the centrifugal weights and is slipped on the distributor shaft (not shown). Further, the screw 80 is screwed on the shaft 61. Finally, the lower part 48 is set on the distributor enclosure 31 and fixed by lateral screws. Then, the circular disc is shifted on the shaft 61. The screw 80 comprises radial lands, which are adapted to corresponding recesses provided in the center of the circular disc and which are dimensioned in their height such that they do not extend over the surface of circular disc (cf. FIG. 16). Likewise, the radial lands do not extend up to the outer margin of screw 80. Due to this, the arcing-over of the high voltage through the recesses provided for the radial lands in the circular disc 10, is eliminated, since otherwise a little gap would occur in the disc 10 at the margin of the screw in the range of the radial lands. Hence, the circular disc 10 is secured against twisting with respect to the screw 80 and is secured from above by means of the screw 65 against jumping from the radial lands. The direction of rotation of the threads for the screws 65, 80, and for the shaft 61, respectively, is orientated such that a slacking is not possible during the rotation of the shaft 61. The top of the shaft 61 is notched and therefore, the rotating position of the shaft 61 is recognizable by an opening provided in the center of the upper part 49.

The screw 80 is located on the shaft 61 such that the circular disc 10 is arranged in the middle of the lateral discs 13, 14. For adjusting the height of the circular disc 10, the shaft comprises an enlarging step provided at the lower part onto which compensating washers are slided before screwing the screw 80. Since the circular disc 10 hardly comprises balance errors, the bearing 66 can be sometimes omitted. At the shaft portion of the shaft 61, in which the circular disc 10 is fixed, the shaft shows a tapering. There, an insulating tape is wound up and the remaining space is filled with silicon mass in order to prevent flash-overs from the electrode ring 81 to the shaft 61 via the supporting position of the circular disc 10 on the screw 80.

In order to prevent arc-overs over the margin of the disc 10 due to surface discharges, the margin of the disc preferably comprises an enlargement 78. Additionally, silicon paste 79 can be provided as accumulation in the range of enlargement 78, since there is no longer a direct air path about the margin of the circular disc. Therefore, the upper and lower parts 48, 49 as well as the discs 13, 14, 10 can be dimensioned to small diameters without risking a flash-over at positions where it is not planned.

The upper part 49 is secured by center pins against rotation on the lower part. Furthermore, said upper part 49 is fixed by screws or a collar band. At the lower margin of the screw 80 a magnet 63 is glued in place in a boring. Opposite the position of the magnet a coil 62 is provided. The magnetic field of magnet 63 passes the coil 62 at each revolution, thus generating a voltage in the coil 62. This voltage is supplied to a processing device 70 producing a signal from which it can be taken whether the shaft 61 is rotating. At the stop of the engine, the signal is supplied to a generator 71 which, for its part no longer triggers a high voltage device so that high voltage is no longer generated.

Figure 16:
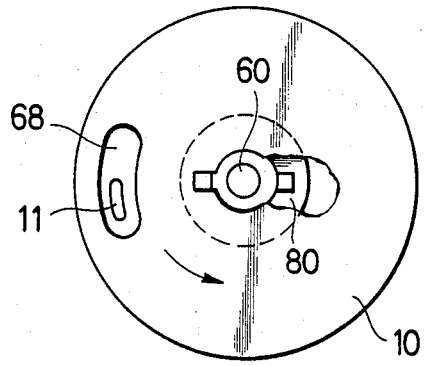
FIG. 16 illustrates an embodiment of a middle circular discs.
Figure 17:
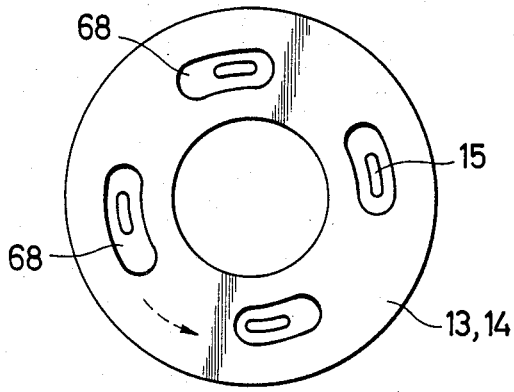
FIG. 17 illustrates an embodiment of a lateral part disc.

In FIGS. 16 and 17 the circular disc 10 and one of the lateral discs 13, 14 are shown in the top view. The openings 11, 15 of the discs are formed as lengthy cut outs having a bowradius corresponding to the radius of the electrodes. In order to avoid the manufacturing of the disc from an entire disc of ceramics, the discs, e.g., consist of a laminate of epoxy resin/glass silk, and the region of the openings 11, 15 is covered by thin ceramics laminates. Preferably, aluminiul oxide is used as ceramics. Ceramics laminas of the size of 0.0197 in (0.5 mm) are sufficient which are bonded on the discs of epoxy resin. The openings provided in the ceramic laminas 68 incorporated by diamond drills whereby preferably vinegar is used as chilling oil or coolant.

The ceramics laminas contribute to increase the durability of the disruptive discharge edges, since the ceramics material longer resists against the heat development of the spark discharge. Since the plasma channel of the spark discharge is slightly pulled by the trailing edge of the opening 11 during rotation of circular disc 10, before the plasma channel is cut off, the ceramics laminas 68 provided at the upper and lower sides of the circular disc 10 are extended a few against the direction of rotation. The ceramics laminas provided at the lateral disc are extended a few in the direction of ratation (cf. FIGS. 16 and 17). The entraining of the plasma channel depends on the width of the air gaps between the discs. The air gaps in the embodiment lie in the range of 0.0197 in (0.5 mm).

The manufacturing of the discs 10, 13, 14, described with respect to FIGS. 16 and 17, is especially suited for special or single makings, as for example, for an ignition system of a racing engine, in which the length of the openings has to be adapted to the spark discharge duration of the engine. In this case, the openings differ from engine to engine, and have to be additionally varied in conformity with the desired engine output. However, with regard to series production, the discs are preferably manufactured as entire discs by sintering aluminium oxide powder by processing by means of laser beams.

Due to the high dielectric constants $\epsilon_c$, solid discs of ceramics, or, e.g., glass, porcelain tend to have surface discharges and a capacitive transfer of an alternating high voltage. Furthermore, the discs made out of the above materials tend to become misted with water vapour. The water film would at least temporarily decrease the insulating effect of the discs and would act as an electrical conductor.

However, sufficient heat is produced by same discharges so that the water film quickly vaporizes. In order to reduce this effect of this disadvantage—especially the formation of surface discharges—it is suggested to coat the ceramics discs with another material so as to especially prevent discharges over the margin of the circular disc 10. Therefore, the risk of surface discharges is reduced an the diameter of the discs can be dimensioned smaller. The type of the coating material depends on the electrode configuration and on the kind of the high voltage (DC or AC). It has turned out that, with alternating high voltage of the tip/tip-electrodes according FIG. 15, a coating of the ceramics discs by a material having lower dielectric constants is more advantageous than with the ceramics material itself. In other words, the coating material has to tend less to surface discharges than the ceramics material. Especially good results were obtained with an epoxy resin/-glass silk—laminate and silicon paste or silicon caoutchouc.

Figure 18:
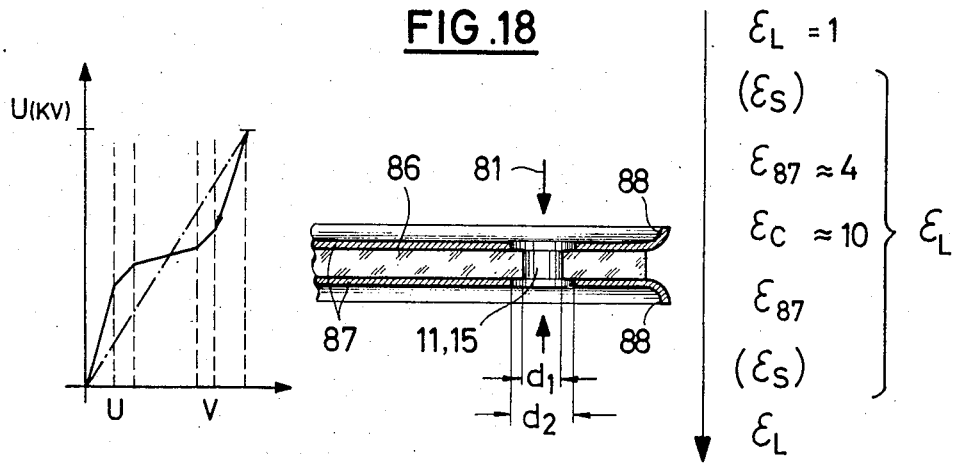
FIG. 18 illustrates a cross sectional view of the disc.

FIG. 18 shows a cross section through a coated disc 86 of aluminium oxide. The disc 86 is laterally coated with epoxy resin which, e.g., is glued in place. The epoxy resin layers 87 are pulled up at the margins so that additional protection is obtained against discharges over the margin and the edge extending is increased. In addition thereto, the epoxy resin layers 87 could be coated with a thin silicon film. For further raising the surface-leakage path resistance and the discharge path, the surface of the discs may be corrugated, so that a wave crest of the lateral disc projects into a wave trough of the circular disc, and vice versa. Thus the wave crest an trough form concentric circles around the rotary shaft.

FIG. 18 further shows an opening, the width d1 of which is preferably smaller than the opening width d2 of the coating 87. Furthermore, the length of the opening in the coating extends over a range in which—as described in FIGS. 16 and 17 with respect to the ceramics lamina—the plasma channel is entrained. If the solid material of the layers shown in FIG. 18 is located between the electrodes, the dielectric constants $\epsilon_l$ of the air, the silicon layer $\epsilon_s$ (is provided), the coating $\epsilon_{87}$, the ceramics layer $\epsilon_c$ will sucessively follow from one electrode to the other and the same dielectric constants will follow once again mirror-inverted when the coating is symmetrical. In this case, the voltage curve via the electrode gap d of the high voltage U is valid as shown by the continuous line. If the spark gaps are crossed by the openings 11, 15, the dielectric of the coating and the ceramics disc ($\epsilon_s$, $\epsilon_{87}$, $\epsilon_c$, $\epsilon_{87}$, $\epsilon_s$) is replaced by the dielectric of the air or of the gas between the spark gaps. This is shown by the dot-dash curve, and the effect of the insulating disc is recognizable, by which the height of the discharge voltage is reduced between the points u, v (dU/dd of the insulating layer is lower than the dU/dd of the air between the points, u, v). Since the bending of the curve essentially depends on the largeness of the dielectric, the correct selection of the insulating materials is especially of importance in the case when the discs are to have small diameters. Therefore, the ceramics material essentially has the function of resisting against the heat development of the plasma channel and of providing the disc with giving sufficient consistency. The coating substantially serves to lower the tracking current, the diameter of the discs and the formation of surface discharges. Particularly, the openings 15 provided on the lateral discs 13, 14 have the function of guiding the flux lines into a predetermined direction and of accepting that only defined portions flow through it. If the slots are to narrow, the discs 13, 14 act as screens; therefore, the slot width is an essential criterion for determining and controlling the trigger point of the discharge. In the embodiment according to FIG. 15, the slot width amounts to 0.039–0.079 in (1–2 mm). Furthermore, the edges of the openings have the function of releasing or of interrupting the discharge, as explained above (FIG. 5). Hence, the present invention relates to an ignition system triggered by flux lines in which the intensity of field is directly controlled according to the ON/OFF-conditions, by the rotational speed of the engine. That means that the high voltage is directly switched by the rotational speed of the engine, since the output value $\omega$ of the engine driving the circular disc 10 is the input value of the ignition system. Of course, the circular disc 10 can be directly coupled to the crankshaft.

Figure 19:
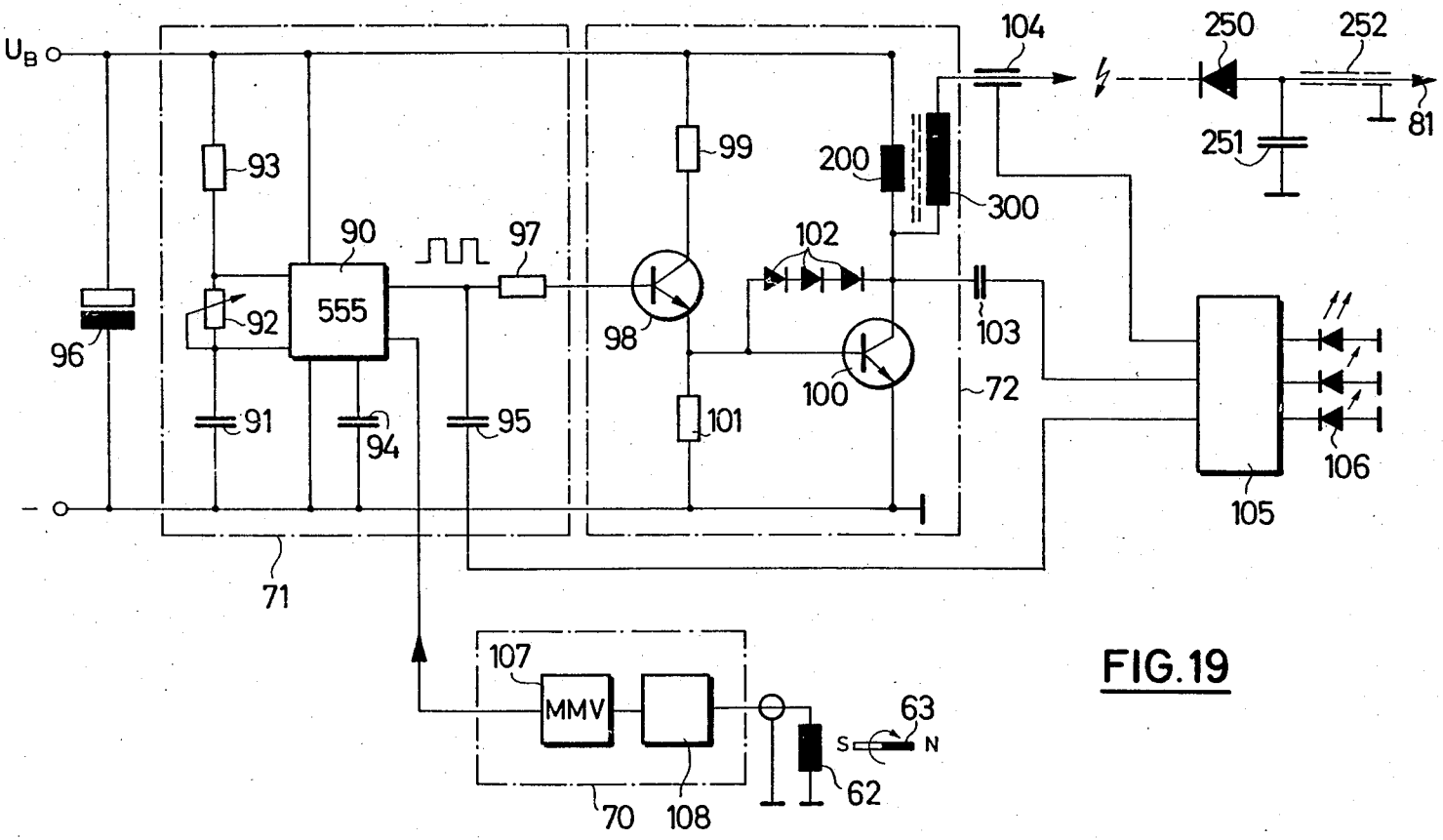
FIG. 19 illustrates an electronic circuitry for controlling and generating a continuous-high-voltage.

FIG. 19 shows a circuit diagram for generating a continuous high voltage. The componentries 70, 71 and 72 of FIG. 15 are indicated by dot-dashed lines. The generator 71 consists of a timer 90 which, e.g., is an IC 555. The timer 90 also can be constituted by an astable multivibrator. The timer 90 supplies a square wave, the frequency and duty cycle of which are determined by the resistors 92, 93 and the capacitor 91. The capacitor 94 serves to improve the edge steepness of the square wave.

The square-wave signal is supplied via a resistor 97 to a driver transistor 98, which is accommodated in the high voltage part 72. The driver transistor 88 comprises in the collector line a power resistor 99 and in the emitter line a resistor 101. The tap for the base terminal of a power transistor 100 can be selectively connected to the collector or the emitter of the transistor 98. The collector of the power transistor is connected to the primary winding 200 of an ignition transformer, and the emitter is grounded. Safety diodes 102 are provided between collector and base of the power transistor 100. In case of need, further safety parts can be provided between collector an emitter. The operation voltage $U_B$ is hum-reducted by an electrolyte capacitor. Depending on the energy requirements of the sparks, the operation voltage $U_B$ can be higher than the line voltage of the car. Therefore, the line voltage can be increased to a higher level by means of a power converter. If the operation voltage $U_B$ is doubled, the primary ignition current is doubled due to the primary winding 100 and the spark energy is quadrupled.

On account of correspondingly steep trailing edges of the square wave signal, the power dissipation of the power transistor 100 is lowered. Said power transistor 100 showing—when switched off—a kick-back voltage at the collector. Said kick-back voltage is transformed with the secondary winding to ignition high voltage in known manner. The frequency of the square-wave-signal is constant and independent of the engine rotational speed. Thus, an ignition puls is generated continuously and independent of firing points. Hence, the ignition transformer 200/300 comprises a fixed operating point, and the transformer can be optimized to this point. The frequency of the square-wave-signal preferably amounts to 10 kHz which would correspond to a theoretical engine speed of 300,000 rpm (four-cylinder engine). Due to the high frequency, the ignition transformer comprises a ferrit core so that a capacitor between collector and ground is not necessary due to the interwinding capacitancies. The high frequency requires small interwinding capacitances which can be optimized by a corresponding selection of thickness of the insulating material between the secondary winding layers and the winding width. By means of the potentiometer 92 the manufacturing tolerances of the ignition transformer can be balanced by varying the frequency of the square-wave-signal until the ignition transformer emits a maximum ignition voltage. According to the use, a push-pull ignition transformer can be provided.

If the openings 11, 15 are opened in the lower engine speed for about 20 ms, 200 ignition sparks would be supplied at 10 kHz as needle pulses to a spark plug 5. Therefore, the discharge rise would depend on the increase rate of the high voltage and on the discharge speed. When the high voltage is converted from pulse voltage to direct voltage, the edge of the ignition pulse would only depend on the disruptive discharge mechanism. For rectification a high voltage rectifier 250 is used. A capacitor 251 can be connected behind the rectifier for filtering. The capacity of the capacitor 251 lies in the range of 1000 pf and corresponding to an increase of the capacitor, more spark energy ($W_c=0.5\ CU^2$) can be interstored. In this connection, it is possible to achieve in an advantageous way that the high voltage can be interstored at those times at which the spark gaps are interrupted by the circular disc 10. Thus, if the opening 11 of the disc 10 releases the spark gap, energy can flow from the capacitor 251 and the ignition transformer 200/300 which is supplied to the electrode ring 81 an to the spark plug 5. The high voltage is preferably negative-rectified. Additionally, there exists the possibility to screen the ignition wire 252, since the direct high voltage involves no capacitive losses. Hence, the ignition wires can be radio-screened in an easy way. Since the high voltage is continuously generated with no reference to the firing points, it has been talked of a continuous high voltage which is used as direct voltage or as pulse/alternating voltage.

The processing device 70 comprises, e.g., a monostable multivibrator 107, which detects via a pulse former 108 the signal of the coil 62 (FIG. 15) detecting the ratation of the magnet 63. The connecting line between the coil 62 and the pulse former 108 is shielded. Likewise, the coil 62 is shielded against interference pulses caused by the spark overs. At an engine stop, no more voltage is generated in the coil 62, thus, the monostable multivibrator 107 is no longer swept from its position of rest. Hence, no signal is supplied to the timer 90, which, due to this, interrupts the generation of square-wave-signals. When there are no square-wave-signals, the power transistor 100 is no more switched and the high voltage generation is interrupted. A VMOS-transistor can also be used as power transistor 100.

At appropriate circuit points—as, e.g., the outputs of a stage—pulses are coupled out by capacitors 95, 103, 104 according to FIG. 19. The coupled-out signals are supplied to a monitoring device 105 which detects whether the coupled-out signals are in fact produced. The absence of a signal or its existence are indicated by display elements, e.g., LED's. The light-emitting diodes are arranged, e.g., in a panel of a motor car. Therefore, it is immediately recognizable at a failure which stage is still workable, for example, there is an error in the device according to FIGS. 13 or 15. The detector device comprises for each signal to be detected a peak value detector, the output signal of which is supplied to a Schmitt trigger-circuit which controls via the display elements a switching stage.

Figure 22:
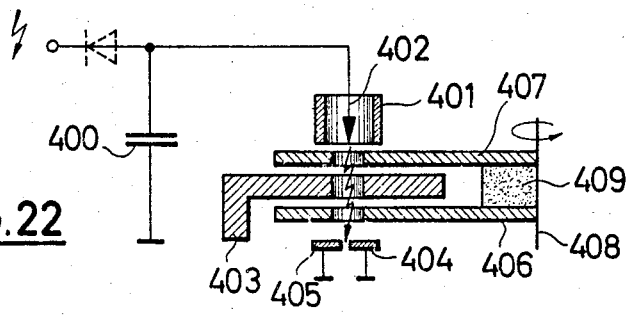
FIG. 22 illustrates a device for welding metals, which are hard to be connected to each other.

The present invention relates to an ignition system for internal combustion engines with a spark ignition. However, the device according to FIGS. 13 and 15 can also be used as high voltage switch. This high voltage switch can be used in a capacitor stored-energy welding machine. The welding deposit 404, 405 itself can form the electrodes (FIG. 22). Likewise, the high voltage switch can be arranged in series to the electrodes and to the welding deposit. The reference numerals 401 and 403 designate stationary insulating parts. By way of example, two rotating discs 406, 407 are shown in profile. The discs 406, 407 are driven around the middle shaft 409. The discs 406, 407 are not completely shown in their diameter. When the openings in the discs 406, 407 release the discharge channel, welding energy from a capacitor 400 and a source not shown can be transferred via an electrode 402 to the welding deposit.

What is claimed is:

1. A high voltage switch for transferring electrical energy to spark plugs of an internal combustion engine, comprising:

(a) a plurality of stationary, elongate first electrodes (1) equally spaced apart along a circular path, (b) an equal plurality of stationary, elongate second electrodes (2) equally spaced apart along a circular path and individually axially aligned with the first electrodes, the second electrodes being individually connected to an equal plurality of spark plugs, (c) a source of continuous high voltage electrical energy (72) directly and continuously connected to each of the first electrodes, (d) a first insulator disc (13) disposed closely proximate tips of the first electrodes and having a plurality of equally radially and circumferentially spaced through apertures (15) individually overlying said electrode tips, aligned therewith, and having an outer surface spaced therefrom, (e) a second insulator disc (10) disposed parallel to, closely proximate, and between both the first disc and tips of the second electrodes, and having a through aperture (4) radially spaced from a center of the second disc a distance equal to the radial spacings of the first disc apertures, and (f) means for rotatably driving the second disc in synchronism with the engine speed such that the aperture thereof successively axially aligns with the aligned first and second electrodes and first disc apertures to enable energy transfers between the electrodes and thus from the source to the spark plugs.

2. A switch according to claim 1, further comprising a third insulator disc (14) disposed closely proximate the second electrode tips and having a plurality of equally radially and circumferentially spaced through apertures individually overlying said second electrode tips, aligned therewith, and having an outer surface spaced therefrom, said third disc lying parallel to and closely proximate the second disc.

3. A switch according to claim 2, wherein the first and third discs are rotatably adjustable over small angular ranges to vary the switch timing and transfer characteristics.

4. A switch according to claim 2, further comprising an apertured, insulatory shield (22, 39) slidable over a surface of one of the discs for varying an aperture opening therein.

5. A switch according to claim 2, further comprising a plurality of apertured ceramic members (68) individually mounted to and overlying the apertures of the first, second and third discs.

* * * * *